United States Patent [19]

Brehm

[11] 4,027,466

[45] June 7, 1977

[54] PROCESS FOR CONTINUOUSLY TREATING THERMOPLASTIC YARNS

[75] Inventor: Gustav Brehm, Wattwil, Switzerland

[73] Assignee: Heberlein Maschinenfabrik AG, Wattwil, Switzerland

[22] Filed: May 25, 1976

[21] Appl. No.: 689,919

[30] Foreign Application Priority Data

June 17, 1975 Switzerland ..... 7883/75

[52] U.S. Cl. ..... 57/34 HS; 28/62; 57/157 TS

[51] Int. Cl.[2] ..... D02J 13/00; D01H 13/28

[58] Field of Search ..... 57/34 HS, 157 R, 157 TS, 57/34 R; 28/62

[56] References Cited

UNITED STATES PATENTS

| | | | |
|---|---|---|---|
| 3,283,414 | 11/1966 | Crouzet | 28/62 UX |
| 3,362,148 | 1/1968 | Hofstetter | 57/34 HS |
| 3,364,294 | 1/1968 | Garibian et al. | 28/62 X |
| 3,626,558 | 12/1971 | Parker | 28/62 |
| 3,650,103 | 3/1972 | Farrer et al. | 57/34 HS |
| 3,701,268 | 10/1972 | Treptow et al. | 28/62 UX |
| 3,803,674 | 4/1974 | Seem et al. | 57/34 HS X |

*Primary Examiner*—Donald Watkins
*Attorney, Agent, or Firm*—Larson, Taylor and Hinds

[57] ABSTRACT

An installation and process for false-twisting thermoplastic yarn are described werein the heat treating units are arranged in double rows along opposite sides of an inspection passage and within a closed chamber. The double row on one side is arranged as a mirror image of that on the other side. Each heating unit consists of a vertical, electrically heated guide for the yarn and these are arranged in vertical hot air ducts. Hot air is admitted centrally at the bottom of the chamber, and passes upwards and then downwards through the ducts to be sucked out of the chamber beneath the heating units. This exhausted air passes through devices for removing sizing agents, as by burning these, and the air then passes through a heat exchanger to a suction fan. The ingoing air is brought from outside the room in which the installation is mounted and passed through the heat exchanger to the chamber the yarns are fed downwards through one row in each double row, then out of the chamber, through cooling means and a row of twist imparters close to the adjacent side of the chamber.

15 Claims, 6 Drawing Figures

PROCESS FOR CONTINUOUSLY TREATING THERMOPLASTIC YARNS

FIELD OF THE INVENTION

The present invention relates to a process for continuously treating thermoplastic yarn, particularly to a false-twisting process with mechanical deformation of the yarn and heat-setting of the deformation in at least one heat treatment zone.

DESCRIPTION OF THE PRIOR ART

It is know to exhaust air from the heat treatment zone in such a process so as to remove vapours of sizing agents which are liberated from the yarn in the heat treatment zone. In known installations for this process, on one side of the apparatus containing the heat treatment zone, air is removed and then exhausted into the free atmosphere, whereas on the opposite side, air is taken from the surrounding atmosphere by the suction thus produced. The air of the surrounding atmosphere, i.e. of the building in which the machines are placed, must however be conditioned and kept at 22° C at 60% air humidity, since the bobbins of raw and treated yarn are also stored in this building. Depending on the outdoors climate, considerable energy is needed for this purpose, particularly in a tropical climate, and, as will be understood, the amount of energy needed therefore increases with the amount of air removed and thereafter exhausted from the building into the free atmosphere. As a consequence of suction of air into the heat treatment zone, furthermore, the vapours of sizing agents condense in the relatively cool air and are deposited in liquid form on the heating surfaces, forming undesirable residues and soiling the surfaces. Finally, suction of air from the heat treatment zone causes considerable heat loss which leads to further consumption of energy.

SUMMARY OF THE INVENTION

It is the purpose of the present invention to reduce the consumption of energy necessary for yarn treatment, or alternatively to achieve higher production speeds with the same energy consumption, while avoiding any enlargement of the heat treatment zone.

In a process of the above-mentioned kind, this problem is resolved by feeding heated air to the heat treatment zone through which the yarn is passed and by sucking said heated air through the heat treatment zone. By this measure, condensation of vapours of sizing agents within the heat treatment zone is avoided so that these can be removed completely by the current of air. Furthermore, with the same size of the heat treatment zone, the transfer of a larger quantity of heat can be achieved per quantity of yarn so that the speed of the yarn moving through the heat treatment zone, or alternatively the speed of production, can be increased.

In an advantageous embodiment of the process, the air to be fed to the heat treatment zone can be heated by the air sucked from the heat treatment zone so that a considerable part of the heat transferred to the air in the heat treatment zone is fed back to the heat treatment zone by the air entering into the heat treatment zone.

In a further advantageous embodiment of the process, the air to be fed to the heat treatment zone is fed from outside the room in which the installation for the present process has been placed. The advantage of this consists in that loading of the air conditioning equipment of this room by removal of the quantity of air necessary for the heat treatment zone is avoided.

It is further advantageous to guide the air, before it enters into the heat treatment zone, along the outside of the wall limiting the heat treatment zone so that a transfer of heat occurs between this wall and the air and a loss of heat through this wall, which would load the air conditioning equipment, is avoided.

The air leaving the heat treatment zone may advantageously be fed to an installation for separating or burning the vapours of the sizing agents so that condensation in the following pipe system or in the heat exchanger is avoided. With this extensive cleaning of the air from vapours of sizing agents, it is also possible to recirculate a part of the air back into the heat treatment zone.

For executing the process of the present invention, an installation is furthermore proposed, comprising devices for guiding the yarn from a raw yarn supply to a winding-up station, these devices comprising means for mechanically deforming the yarn, at least one heat treatment unit being provided between the supply of raw yarn and the winding-up station, and which is characterized in that the heat treatment apparatus is in a chamber which is closed and heat-insulated from the supply of raw yarn and from the winding-up station, a supply pipe for heated air and a suction pipe connected with the heat treatment unit being connected with the closed heat-insulated chamber. In this manner, it is achieved among others that the heat treatment unit cannot exchange any heat with the surrounding conditioned air and that the heat delivered from its closing walls cannot reach the air which is afterwards sucked into the heat treatment unit.

In a plant comprising more than one heat treatment unit arranged one behind the other in direction of yarn movement, such as for example for post-setting of the deformation of the yarn, these heat treatment units can advantageously be combined in a plant according to the present invention that they have at least one common closure wall. The advantage of this embodiment consists in that, through the common closure wall, only mutual heat exchange takes place with a lower temperature gradient than with the conditioned surrounding air.

It will be understood, of course, that, in a heat treatment unit, in a known manner, numerous yarns can be treated in a row of treatment stations in parallel beside each other, with a corresponding number of yarn supplies, guiding devices, and other necessary devices, numerous contact heating plates or heating tubes over or through which the yarn passes being arranged in each heat treatment unit. In this case, the heat-insulated chamber which encloses the heat treatment unit may advantageously additionally comprise the heat treatment unit or units for a second parallel row of yarn treatment stations, a passage for inspection being formed between the two rows.

DESCRIPTION OF THE DRAWINGS

The invention will now be described in more detail with reference to an example shown in the accompanying drawings wherein:

FIG. 1 shows schematically the generally known basic principle of false-twisting apparatus. Yarn 1 is removed from a yarn supply 3 by a delivery device 2 consisting of two rollers, is then passed through a heat treatment unit 4, followed by a cooling device 5, before the yarn reaches a twist imparter 6 and then a delivery device 7. Mechanical deformation of the yarn is effected between delivery device 2 and delivery device 7, by imparting to it a false-twisted by twist imparter 6. It can simultaneously be stretched by running the delivery devices 6 and 7 at different speeds. By the heating effected in the heat treatment unit 4 and the subsequent cooling, reorientation of the yarn molecules is effected, and this reorientation remains after cooling and after the yarn has left the twist imparter. For producing low-stretch crimp yarns, the yarn, after passage through the delivery device 7, can be passed through a second heat treatment unit 8. For producing determined tensions in this second heat treatment, a second delivery device 9 is provided downstream of the heat treatment unit 8, before the yarn reaches the winding-up station 10.

Assemblies or stations according to this general principle are usually arranged in large numbers in each of several successive rows in installations in a machine hall so that each individual heat treatment unit 4 in a row forms part of an apparatus common of all such heat treatment units in the row and so that the driving, for example of the delivery devices 6 and 7, can be effected by common driving shafts.

Figure 6:
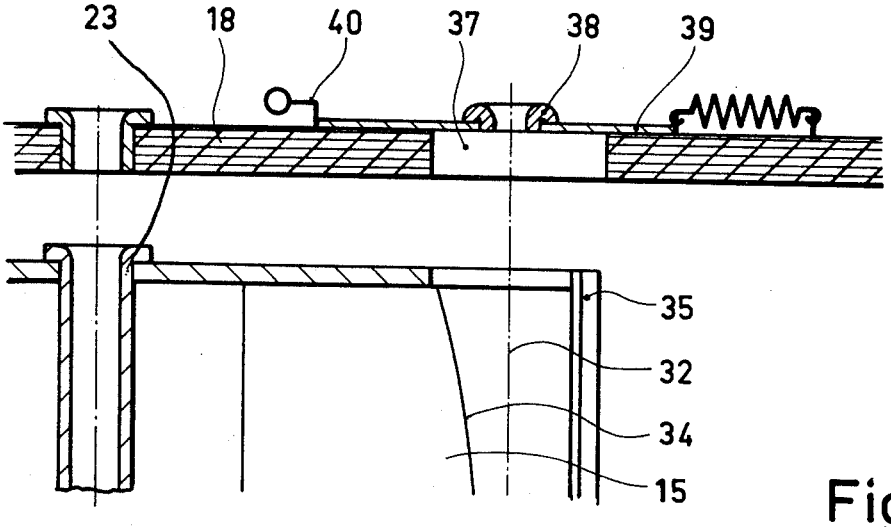
FIG. 6 is a vertical cross-section showing a portion of the apparatus in and adjacent the area III in FIG. 4 on an enlarged scale and in detail.
Figure 4:
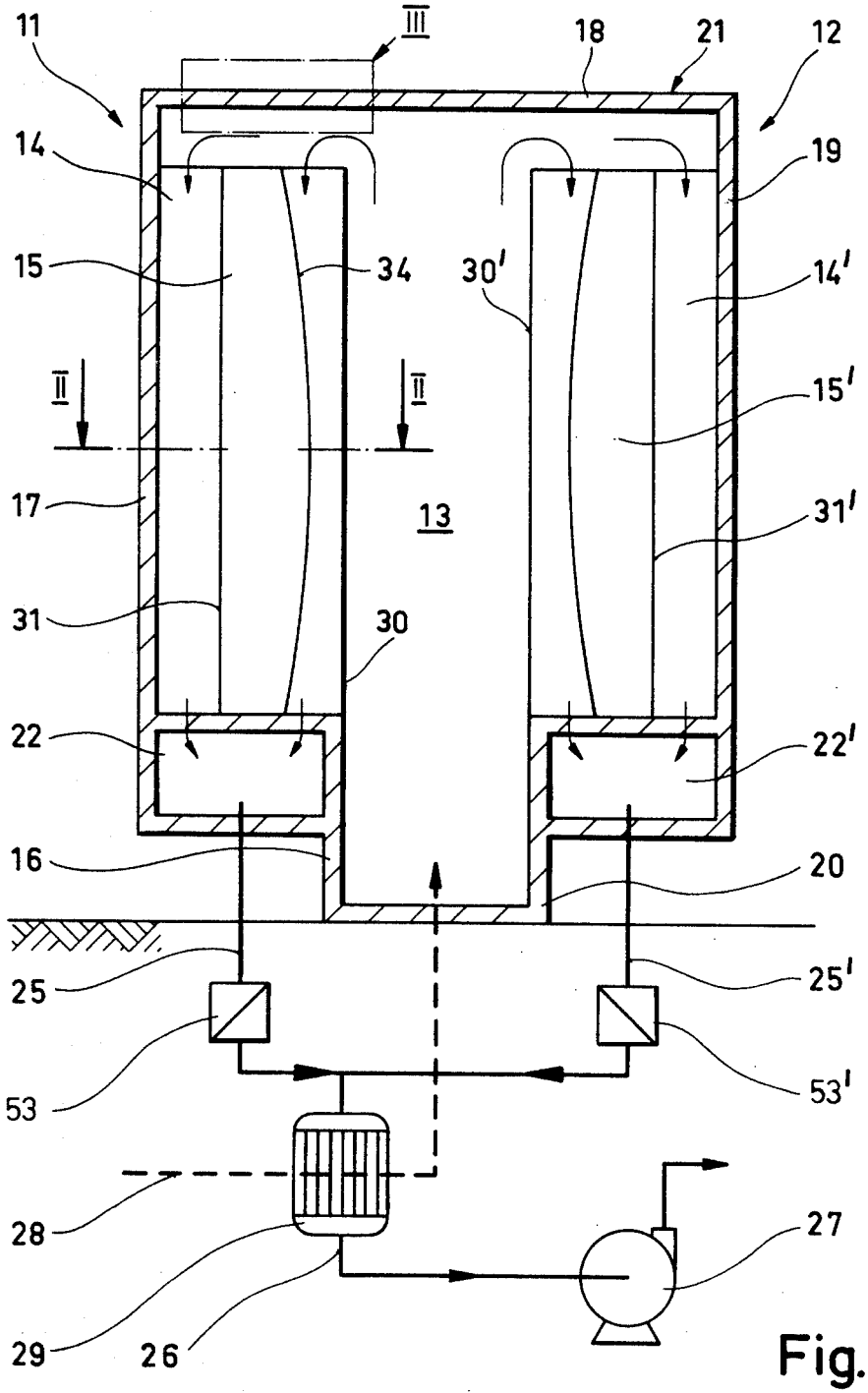
FIG. 4 is a diagram showing how air flows through the installation of FIG. 2.

FIG. 4 shows a cross-section through a machine with the yarn treatment units (14, 15, 14′, 15′) of two parallel rows 11, 12 in a yarn treatment installation, the rows of yarn treatment stations being arranged so that one is a mirror image of the other. Between the two rows 11, 12, an inspection passage 13 is provided from which all the heat treatment units are accessible, for example for cleaning. The inspection passage 13 is surrounded, together with the heat treatment units 14, 15, 14′, 15′, by closure walls 16 to 20 of a chamber 21 closed and heat-insulated from the outside, whereas the remaining parts of the installations, i.e. the devices for guiding and false-twisting the yarn are arranged in the surrounding air-conditioned room, as is shown better in FIG. 2. The closure walls 16 to 20 of chamber 21 are made from a heat-insulating material so that no serious heat transfer takes place from the chamber 21 to the outside. The passages for the yarns into the chamber are sealed to a great extent, as for example shown in FIG. 6.

Figure 1:
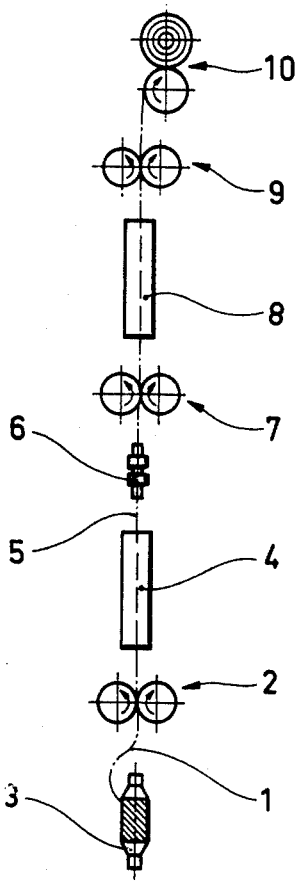
FIG. 1 shows schematically a known apparatus for false-twisting thermoplastic yarn.
Figure 5:
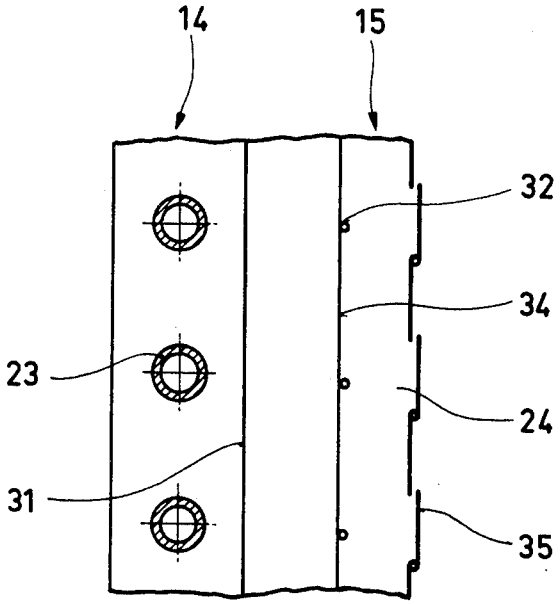
FIG. 5 is a horizontal section along line II-II of FIG. 4, but on an enlarged scale and depicted in greater detail.
Figure 2:
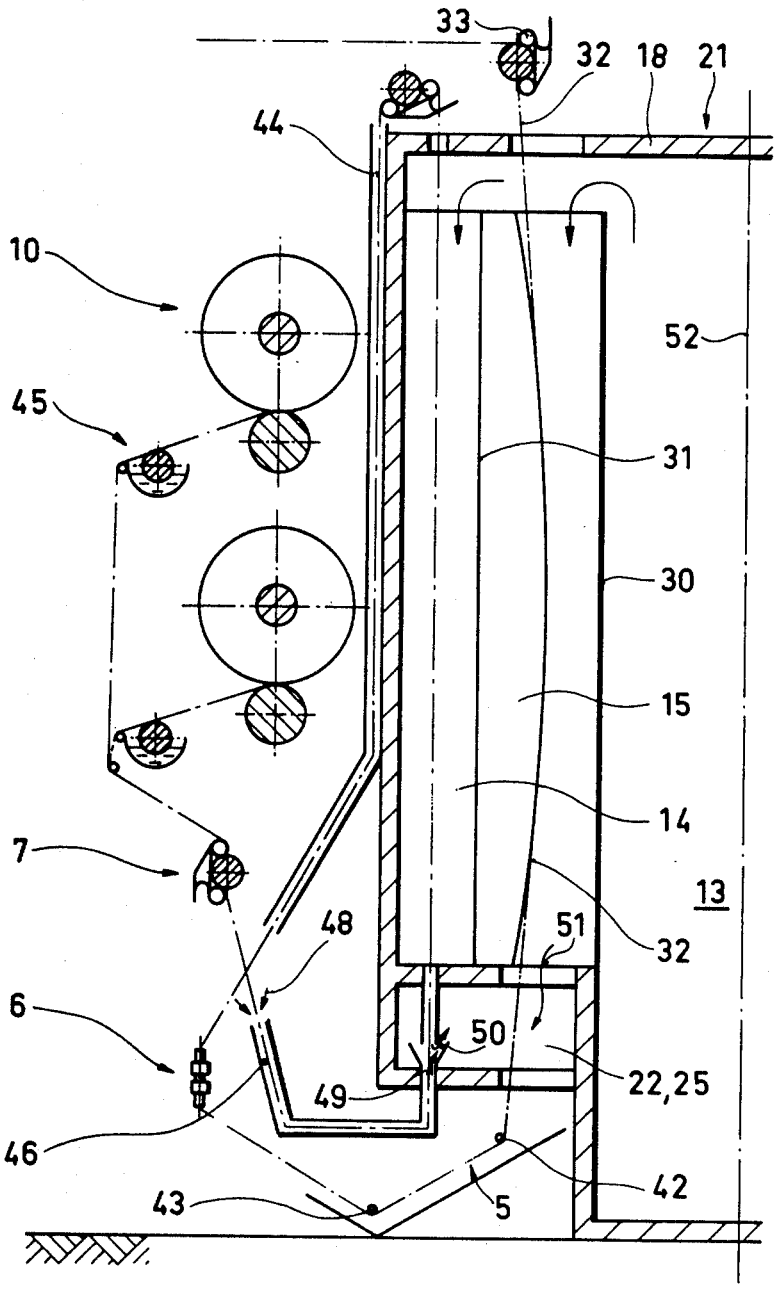
FIG. 2 shows schematically a vertical section through one side of an installation in accordance with the present invention for false-twisting thermoplastic yarn.
Figure 3:
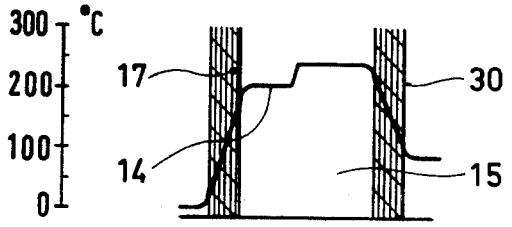
FIG. 3 is a diagram of an approximate temperature profile transversely through heat treatment units in the installation of FIG. 2.

As in other known installations, air is sucked through the heat treatment units 14, 15, 14′, 15′, to remove the vapours of the sizing agents. For this purpose, in the present example, a suction channel 22 or 22′ is provided under each unit 14, 15 or 14′, 15′ in the treatment stations, the suction channels 22, 22′ being connected by openings described below with the interior of the units or more precisely with heating tubes or heating channels 23, 24 (FIG. 5) in the units, through which the yarn passes. These suction channels 22, 22′ are connected to a suction fan 27 by schematically shown pipes 25, 25′, 26 which lead out of the chamber 21. By suction of air from the lower ends of the heat treatment units 14, 15, 14′, 15′, air is sucked from the outside through a pipe 28, indicated by dashed lines, to circulate by passing upwards through the passage 13 and downwards through units 14, 15, 14′, 15′. This air is advantageously sucked in, in a manner not shown, from the outside of the machine hall surrounding the chamber 21, i.e. as fresh air, to avoid any load on the air-conditioning equipment of the hall. This air is heated in a heat exchanger 29 by the heated air sucked out through pipe 26. Further heating of this air, before it enters the heat treatment units, is effected in chamber 21 by the heat delivered by the heat treatment units through walls, 30, 30′. It will be understood that these walls 30, 30′ do not need any considerable heat insulation. The temperature profile which then results transversely through the heat treatment units 14, 15 of FIG. 2, is shown in FIG. 3. In the first heat treatment units 15, the temperature of the contact heating surfaces if for example 220° C, in heating tubes 23 of the second units 14 for post-setting the temperature is 200° C and in passage 13 where the incoming air is heated by heat exchange the temperature is for example 100° C.

The temperature profile furthermore clearly shows that the temperature gradient through the closure wall 30 towards the side of the intermediate space 13 and through a closure wall 31 if provided between the first heat treatment unit 15 and the second heat treatment unit 14 is essentially smaller than towards the temperature outside the chamber 21, i.e. for example a temperature of 22° C, as usual in known installations. Accordingly, the heat treatment units have an essentially lower heat loss. Furthermore, less heat is lost to the air because this is already heated when entering the installation. It therefore is also clear that the immediate contact between the two heat treatment units 14, 15 along their common surface is of considerable importance, for it reduces the surface through which the heat necessary for heat treatment of the yarn gets lost. As a whole, the result is that, for a given size of the units for heat treatment in comparison with the known units, more heating capacity is available so that the production rate or the speed of yarn movement through the installation can be increased significantly.

FIG. 2 shows an example of the way in which the yarns can be guided through one side of the installation comprising a first 15 and a second heat treatment unit 14, which are disposed beside each other in parallel so that they have a common wall 31.

The yarn 32 shown by dash-dot lines is removed overhead from a yarn supply (not shown) and reaches a delivery device 33 and is thereafter introduced through the upper wall 18 of the chamber 21 and into the first heat treatment apparatus 15. This first heat treatment apparatus 15 has a slightly convex, electrically heated heating surface 34, over which the yarn is led in direct contact. For this purpose, a slot 37 is provided in the upper wall 18 of chamber 21 (FIG. 6), and a thread-guide ring 38 is arranged in a movable element 39 which seals the slot 37 so that substantially no air can enter therethrough. Arrangements, the same as that shown in FIG. 6, for sealing the chamber 21 and for moving the yarn, are also provided at the other yarn input locations along the row. The output locations are also sealed as described below, so that the chamber 21 is nearly air-tight. Each movable element can be pulled laterally by a handle 40 against spring action to provide access through the slot 37.

Beneath the heat treatment unit 15, the yarn 32 leaves the chamber 21 through openings at the top and bottom of the suction channel 22, is then deflected upwardly along an angular path over two thread-guides 42, 43 and then reaches the twist imparter 6. This angular path of the yarn corresponds to the cooling path of the known device 5 mentioned above. From the twist imparter 6, the yarn is guided back to the upper part of the station through a tube 44, then reaches the delivery device 7 and then moves downwards into the second heat treatment unit 14.

The unit 14 is also electrically heated and comprises heating tubes 23 (FIG. 5) in which convection heating of the yarn 32 is effected. At the lower end of this second heat treatment unit 14, the yarn, after having left the chamber 21, is again deflected upwards along an angular path through a tube 46 and then fed to the winding-up station 10 through the second delivery device 7 and a sizing device 45. In the cross-section shown in FIG. 2, two winding-up stations 10 for the yarn appear. These are for two treatment stations arranged side by side in the horizontal direction. The heating tubes 23, and heating channels 24 closable with flaps 35, of three adjoining treatment stations, are shown in the horizontal cross-section in FIG. 5.

Air passes through the tube 46 so that accelerated cooling of the yarn is achieved. The air current in this tube is due to a vent in the tube 46 providing communication with the suction channel 22 as shown in FIG. 2. The air is sucked from the channel 22 extending below the row of heat treatment units so that air is sucked from the tube 46 in the direction of arrows 48, 49 and from the heat treatment units 14, 15 in direction of arrows 50, 51. The tube 46 enables, during the threading of the yarn, the yarn to be sucked through the tube 46 by means of a separate suction pipe (not shown) providing a subatmospheric pressure lower than that of the channel 22, with which the tube 46 can be connected at will.

Symmetrically with respect to the plane indicated by dash-dot line 52 (FIG. 2), there is a similar row of treatment stations. The intermediate space 13 between the two rows of treatment stations is accessible, and it will be understood that, for this purpose, doors (not shown) are provided at the ends of chamber 21.

For cleaning the air loaded with vapours of sizing agents, various devices 53, 53′ (FIG. 4), known in principle, such as for example filters, washing devices, separators or even a combustion chamber with a subsequent filter, are suitable. Burning of the sizing vapours is particularly advantageous since waste water is not soiled thereby, and furthermore, the liberated combustion heat can contribute to heating of the air current in the heat exchanger 29.

In a modification at least part of the air is recirculated into the chamber 21.

I claim:

1. An installation for continuously treating thermoplastic yarn comprising an assembly of heat-insulated walls defining a substantially closed chamber and including an upper wall formed with an aperture for the passage of yarn therethrough and a lower wall formed with an aperture for the passage of yarn therethrough, a heat treatment unit mounted in said chamber for heating yarn passing into said chamber through one of said apertures, then through said heat treatment unit and out of said chamber through the other of said apertures, means outside said chamber for mechanically deforming the yarn, a winding-up station for yarn outside said chamber, means for feeding heated yarn leaving said chamber through said yarn deforming means to said winding-up station, means for supplying heated air into said chamber, means for withdrawing air out of said chamber so as to cause air to flow through said chamber and means for directing such air over said heating unit to add to the heating effect thereof.

2. An installation according to claim 1 comprising a second heat treatment unit mounted in said chamber, said upper and lower walls being formed respectively with two further apertures for the passage of yarn therethrough before and after passing said second heat treatment unit and said installation including also means for directing yarn leaving said twist imparter through one said further aperture to pass through said second heat treatment unit and means for feeding the yarn leaving said chamber through the other said further aperture to said winding-up station, said means for directing air being arranged to direct the hot air also over said second heating unit.

3. An installation according to claim 2, in which said two heating units respectively contain substantially vertical, heated guides for the yarn and said means for directing air comprise walls deforming vertical ducts respectively containing said heated guides and having a wall in common.

4. An installation according to claim 2, including a tube leading from the other said further aperture, through which tube the yarn passes to said winding-up station, said tube providing means for connection at will to an additional means for withdrawing air out of said chamber.

5. An installation according to claim 1, including a heat exchanger, said means for drawing air out of said chamber including a suction pump connected to draw air from said chamber through said heat exchanger to surrender heat therein and said means for supplying heated air into said chamber comprising conduit means for leading air through said heat exchanger, to be heated therein and then to said chamber.

6. An installation according to claim 5, including an air cleaning installation in series with said heat exchanger for cleaning the air withdrawn from said chamber.

7. An installation according to claim 5, including a combustion chamber in series with said heat exchanger for burning impurities in air withdrawn from said chamber.

8. An installation according to claim 1, comprising also a yarn cooling device mounted outside said chamber for heated yarn leaving said chamber to pass in sequence through said cooling device and said yarn deforming means to said winding-up station.

9. An installation for continuously treating thermoplastic yarn in a false-twisting process comprising an assembly of heat-insulated walls defining a substantially closed heat insulated, elongated chamber, a first row of heat treatment units distributed within said chamber along one side thereof, a second row of heat treatment units distributed within said chamber along the other side thereof, two rows of twist imparters allocated respectively to said heat treatment units and distributed outside said chamber with one row of yarn cooling devices and one row of twist imparters on one side of said chamber and one row of cooling devices and one row of twist imparters on the other side of said chamber, two yarn winding-up stations outside and respectively on opposite sides of said chamber, said walls including an upper wall formed with apertures for the entry of yarns passing respectively to all said heat imparting units and including a lower wall formed with lower apertures for the passage of heated yarns respectively from said heating imparting units, means for feeding heated yarns from the row of heat imparting units on one side through associated ones of said lower apertures and through said twist imparters on that one side to the winding-up station on that one side and for feeding and heated yarns from the row of heat imparting units on the other side through associated ones of said lower apertures and through said twist imparters on that other side to the winding-up station on that other side, means for feeding heated air into the base of said chamber between said rows of heat imparting units, means for directing the heated air upwards and then downwards over said rows of heat imparting units and means for withdrawing air out of said chamber from beneath said rows of heat imparting units.

10. An installation according to claim 9, in which said rows of heat imparting units are spaced to provide an inspection passage therebetween.

11. An installation according to claim 10, in which each said row of heat imparting units is a double row of heat imparting units, each consisting of a vertical heated guide for yarn, with one row in each double row being adjacent a chamber wall and the other row in the double row adjacent said passage, said air directing means defining vertical ducts respectively containing said heating units and arranged in pairs with a common wall, the ducts in each pair being respectively in the two rows of a double row.

12. A false-twisting process for treating thermoplastic yarn comprising continuously feeding the yarn through a closed chamber containing a heat imparting unit for heating the yarn while passing through said chamber, exhausting air from said chamber, introducing additional heat into said chamber by admitting hot air into said chamber to replace the air exhausted from said chamber, directing said hot air over said yarn while traversing said heat imparting unit, cooling said yarn after leaving said chamber, imparting a twist to said cooled yarn and then winding-up said yarn.

13. A process according to claim 12, in which said hot air is heated by heat exchange with said air exhausted from said chamber.

14. A process according to claim 12, wherein said process is performed in a room, said process including maintaining said room at a substantially constant temperature, introducing air from outside said room to means for heating such introduced air to serve as said hot air admitted to said chamber.

15. A process according to claim 12, wherein sizing agents are removed from the air exhausted from said chamber.

* * * * *